US012704271B2

(12) United States Patent
Adachi et al.

(10) Patent No.: US 12,704,271 B2
(45) Date of Patent: Aug. 11, 2026

(54) HEAT EXCHANGER AND AIR-CONDITIONING APPARATUS

(71) Applicant: Mitsubishi Electric Corporation, Tokyo (JP)

(72) Inventors: Rihito Adachi, Tokyo (JP); Yoji Onaka, Tokyo (JP); Nanami Kishida, Tokyo (JP); Tetsuji Saikusa, Tokyo (JP); Yuki Nakao, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 220 days.

(21) Appl. No.: 18/697,889

(22) PCT Filed: Oct. 15, 2021

(86) PCT No.: PCT/JP2021/038154
§ 371 (c)(1),
(2) Date: Apr. 2, 2024

(87) PCT Pub. No.: WO2023/062801
PCT Pub. Date: Apr. 20, 2023

(65) Prior Publication Data

US 2024/0410602 A1 Dec. 12, 2024

(51) Int. Cl.
*F24F 1/16* (2011.01)
*F24F 1/18* (2011.01)
(Continued)

(52) U.S. Cl.
CPC ..... *F24F 1/16* (2013.01); *F24F 1/18* (2013.01); *F24F 1/30* (2013.01); *F24F 11/70* (2018.01)

(58) Field of Classification Search
CPC ..... F24F 1/16; F24F 11/70; F24F 1/18; F24F 1/30
See application file for complete search history.

(56) References Cited

U.S. PATENT DOCUMENTS 5,826,649 A 10/1998 Chapp et al.
2019/0316803 A1* 10/2019 D'Arcy ..... F28F 27/02
2021/0222893 A1 7/2021 Matsui et al.

FOREIGN PATENT DOCUMENTS

JP S5929986 A 2/1984
JP H04268128 A 9/1992
(Continued)

OTHER PUBLICATIONS

International Search Report and Written Opinion mailed on Dec. 7, 2021, received for PCT Application PCT/JP2021/038154, filed on Oct. 15, 2021, 9 pages including English Translation.
(Continued)

*Primary Examiner* — Larry L Furdge
(74) *Attorney, Agent, or Firm* — XSENSUS LLP

(57) ABSTRACT

A heat exchanger includes a first heat exchanger, a second heat exchanger and an inter-row connecting pipe. The first heat exchanger and the second heat exchanger each include: a plurality of heat transfer tubes extending in a vertical direction and spaced apart from each other in a horizontal direction; a first header located at lower ends of the plurality of heat transfer tubes, having an outlet for refrigerant, and configured to distribute or combine the refrigerant; and a second header located at upper ends of the plurality of heat transfer tubes, having an inlet for the refrigerant, and configured to distribute or combine the refrigerant. The inter-row connecting pipe connects the outlet of the first header in the first heat exchanger and the inlet of the second header in the second heat exchanger.

5 Claims, 9 Drawing Sheets

(51) Int. Cl.
*F24F 1/30* (2011.01)
*F24F 11/70* (2018.01)

(56) References Cited

FOREIGN PATENT DOCUMENTS

| | | | |
|---|---|---|---|
| JP | H10-206041 | A | 8/1998 |
| JP | 2001-304719 | A | 10/2001 |
| JP | 2008-025897 | A | 2/2008 |
| JP | 2010-107102 | A | 5/2010 |
| JP | 2010-107103 | A | 5/2010 |
| JP | 2018-100803 | A | 6/2018 |
| JP | 6595125 | B1 | 10/2019 |
| WO | 2015/063853 | A1 | 5/2015 |

OTHER PUBLICATIONS

Notice of Reason for Refusal mailed on Apr. 5, 2022, received for JP Application 2022-512373, 11 pages including English Translation.
Office Action dated Feb. 12, 2025 issued in corresponding DE patent application No. 112021008373.2 (and English translation), 8pp.

* cited by examiner

HEAT EXCHANGER AND AIR-CONDITIONING APPARATUS

CROSS-REFERENCE TO RELATED APPLICATION

This application is based on PCT filing PCT/JP2021/038154, filed Oct. 15, 2021, the entire contents of which are incorporated herein by reference.

TECHNICAL FIELD

The present disclosure relates to a heat exchanger including a plurality of heat transfer tubes that extend vertically and a header through which the heat transfer tubes communicate with each other, and relates to an air-conditioning apparatus including such a heat exchanger.

BACKGROUND ART

In a known defrosting technique, in a defrosting operation, hot gas refrigerant is caused to flow through a main heat exchange region and an auxiliary heat exchange region in this order. The main exchange region is located in an upper region, and the auxiliary heat exchange region is located in a lower region. In this technique, it takes time to melt frost on downstream fins on a downstream side of a drainage path for water that is generated when heat transfer tubes are defrosted. Inevitably, drainage is hindered. As a result, it takes a long time to defrost the heat exchanger, or an accumulation of ice may occur at a lower portion of a heat exchanger, thus reducing the defrosting performance. In view of such circumstances, a technique has been proposed in which frost on the lower portion of the heat exchanger is preferentially removed to promote drainage (see, for example, Patent Literature 1).

CITATION LIST

Patent Literature

Patent Literature 1: Japanese Patent No. 6595125

SUMMARY OF INVENTION

Technical Problem

In the case where hot gas refrigerant flows as an upward flow through the heat transfer tubes of the heat exchanger in the defrosting operation, when the refrigerant partially liquefies because of heat exchange with frost, the refrigerant fails to flow upward in some of the heat transfer tubes under the effect of a head difference. Part of each of the heat transfer tubes in which the refrigerant fails to flow upward is not sufficiently defrosted, and as a result, the defrosting performance is greatly reduced. In the case where hot gas refrigerant flows upward through the heat transfer tubes, a liquid film decreases in velocity under the effect of gravity, and as a result, the thickness of the liquid film increases. Accordingly, the thermal conductivity is reduced, and the defrosting performance is further reduced.

The present disclosure is applied in view of the above circumstances, and relates to a heat exchanger that is improved in defrosting performance and an air-conditioning apparatus including such a heat exchanger.

Solution to Problem

A heat exchanger according to an embodiment of the present disclosure includes a first heat exchanger and a second heat exchanger and an inter-row connecting pipe. The first heat exchanger and the second heat exchanger each include: a plurality of heat transfer tubes extending in a vertical direction and spaced apart from each other in a horizontal direction; a first header located at lower ends of the plurality of heat transfer tubes, having an outlet for refrigerant, and configured to distribute or combine the refrigerant; and a second header located at upper ends of the plurality of heat transfer tubes, having an inlet for the refrigerant, and configured to distribute or combine the refrigerant. The inter-row connecting pipe connects the outlet of the first header in the first heat exchanger and the inlet of the second header in the second heat exchanger.

Advantageous Effects of Invention

According to the embodiment of the present disclosure, the refrigerant flows into the second header of the first heat exchanger. The refrigerant that has flowed into the second header flows downward through the plurality of heat transfer tubes in the first heat exchanger, and collects in the first header of a first heat transfer tube. The refrigerant that has collected in the first header flows out of the first header through the outlet. The refrigerant that has flowed out of the first header through the outlet passes through the inter-row connecting pipe and flows into the inlet of the second header in the second heat exchanger. The refrigerant that has flowed into the inlet of the second header in the second heat exchanger flows downward through the heat transfer tubes in the second heat exchanger, collects in the first header of the first heat transfer tube, and then flows out of the first header through the outlet. Therefore, in the heat exchanger according to the embodiment of the present disclosure, since the refrigerant flows downward through the heat transfer tubes of the first heat exchanger and through the heat transfer tubes of the second heat exchanger in a defrosting operation, accumulation of liquid refrigerant is reduced, and the thermal conductivity of the heat transfer tubes is improved, thereby improving the defrosting performance.

DESCRIPTION OF EMBODIMENTS

Figure 1:
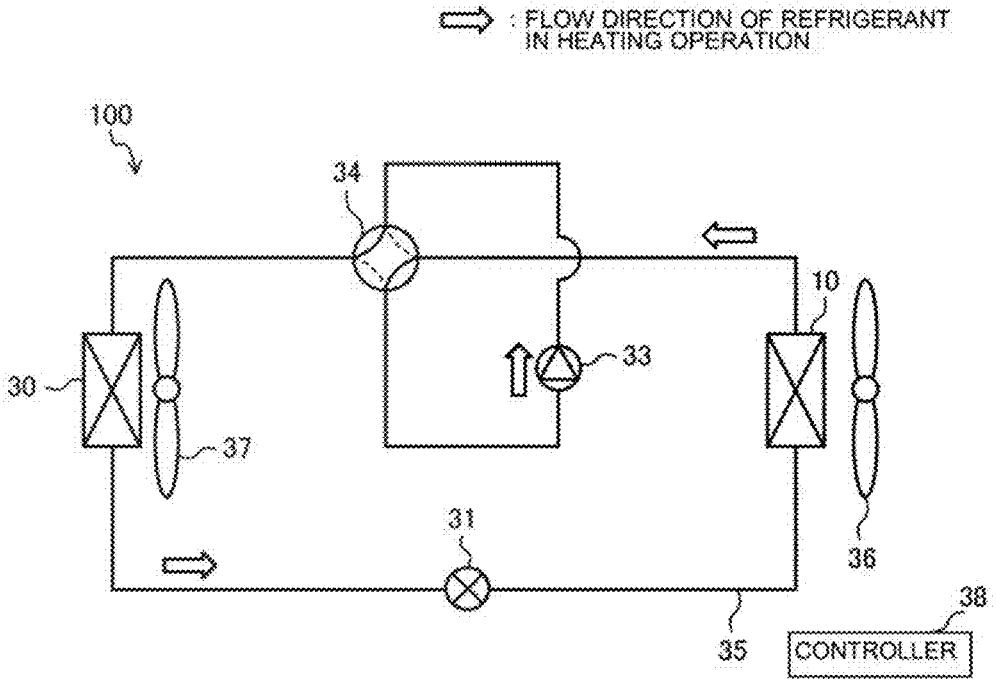
FIG. 1 illustrates a configuration of a refrigerant circuit of an air-conditioning apparatus according to Embodiment 1.

Embodiments will be described below with reference to the drawings. It should be noted that in each of the figures in the drawings, components that are the same as or equivalent to those in a previous figure or previous figures are denoted by the same reference signs. The same is true of the entire text of the specification. In consideration of visibility, in sectional views of the figures, hatching is omitted as appropriate. Furthermore, the configurations of components in the entire text of the specification are described as examples; that is, these descriptions are not limiting. Additionally, the shapes, sizes, and arrangement of components as illustrated in each of the figures can be appropriately changed within the scope of the gist of the embodiments.

Embodiment 1

FIG. 1 illustrates a configuration of a refrigerant circuit of an air-conditioning apparatus 100 according to Embodiment 1. In FIG. 1, arrows indicate the flow direction of refrigerant in a heating operation.

In Embodiment 1, a refrigeration cycle apparatus is used as the air-conditioning apparatus 100. The air-conditioning apparatus 100 includes a compressor 33, an outdoor heat exchanger 10, an expansion device 31, an indoor heat exchanger 30, and a four-way valve 34. In this example, the compressor 33, the outdoor heat exchanger 10, the expansion device 31, and the four-way valve 34 are provided in an outdoor unit, and the indoor heat exchanger 30 is provided in an indoor unit.

The compressor 33, the outdoor heat exchanger 10, the expansion device 31, the indoor heat exchanger 30, and the four-way valve 34 are connected by refrigerant pipes 35, whereby a refrigerant circuit is formed through which refrigerant can circulate. In the air-conditioning apparatus 100, when the compressor 33 is driven, a refrigeration cycle is carried out. In the refrigerant cycle, the refrigerant circulates through the compressor 33, the outdoor heat exchanger 10, the expansion device 31, and the indoor heat exchanger 30 while changing in phase.

The outdoor unit includes an outdoor fan 36 that forcibly causes outdoor air to pass through the outdoor heat exchanger 10. The outdoor heat exchanger 10 causes heat exchange to be performed between the refrigerant and an airflow of the outdoor air that is produced by an operation of the outdoor fan 36. The indoor unit includes an indoor fan 37 that forcibly causes indoor air to pass through the indoor heat exchanger 30. The indoor heat exchanger 30 causes heat exchange to be performed between the refrigerant and an airflow of the indoor air that is produced by an operation of an action of the indoor fan 37.

An operation of the air-conditioning apparatus 100 is switchable between the heating operation and a cooling operation. The four-way valve 34 is a solenoid valve that switches a refrigerant passage between refrigerant passages in response to switching between the cooling operation and the heating operation in the air-conditioning apparatus 100. In the cooling operation, the four-way valve 34 causes the refrigerant from the compressor 33 to flow to the outdoor heat exchanger 10 and causes the refrigerant from the indoor heat exchanger 30 to flow to the compressor 33. In the heating operation, the four-way valve 34 causes the refrigerant from the compressor 33 to flow to the indoor heat exchanger 30 and causes the refrigerant from the outdoor heat exchanger 10 to flow to the compressor 33.

Figure 18:
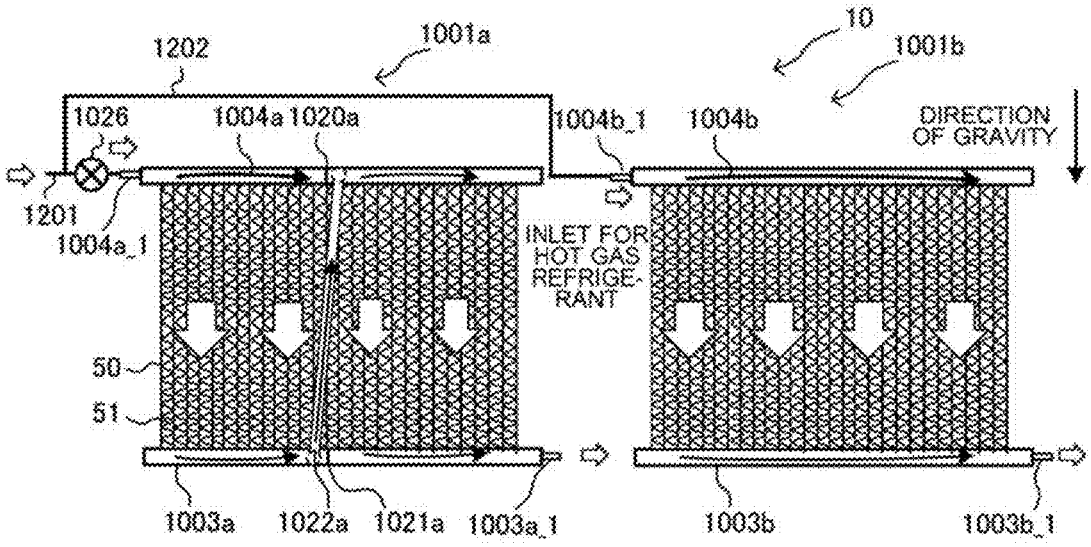
FIG. 18 illustrates a configuration of an outdoor heat exchanger according to Embodiment 4.

A controller 38 controls the entire air-conditioning apparatus 100. The controller 38 controls, for example, the expansion device 31, the compressor 33, the expansion device 31, the outdoor fan 36, and the indoor fan 37. As illustrated in FIG. 18 relating to Embodiment 5, in the case where a flow control valve 1026 is provided in the outdoor heat exchanger 10, the controller 38 controls the flow control valve 1026 in the cooling operation and a defrosting operation. Although FIG. 1 illustrates a single controller 38, the indoor unit and the outdoor unit may include respective controllers 38.

In the case where the controller 38 is a processing circuit that is dedicated hardware, the processing circuit corresponds to, for example, a single-component circuit, a composite circuit, an application specific integrated circuit (ASIC), a field programmable gate array (FPGA), or a combination of these circuits. Function parts of the processing circuit may be implemented by respective hardware or may be implemented by single hardware. In the case where the processing circuit of the controller 38 is a CPU, functions of the processing circuit are fulfilled by software, firmware, or a combination of software and firmware. Software and firmware are written as programs and are stored in a storage unit 109. In order to fulfill each of the functions of the processing circuit, the CPU reads an associated program from the storage unit 109 and runs the program. It should be noted that some of the functions of the processing circuit may be fulfilled by dedicated hardware, and others of the functions may be fulfilled by software or firmware.

Operation of Air-Conditioning Apparatus in Heating Operation

As illustrated in FIG. 1, low-temperature and low-pressure gas refrigerant is sucked into the compressor 33, and is changed into high-temperature and high-pressure gas refrigerant. The high-temperature and high-pressure gas refrigerant is discharged from the compressor 33 and then passes through the four-way valve 34. After that, the refrigerant flows into the indoor heat exchanger 30.

The high-temperature and high-pressure gas refrigerant that has flowed into the indoor heat exchanger 30 exchanges heat with air supplied by the indoor fan 37, transfers heat to the air, and thus condenses and liquefies to change into high-temperature and high-pressure liquid refrigerant. The high-temperature and high-pressure liquid refrigerant then flows out of the indoor heat exchanger 30.

The liquid refrigerant that has flowed out of the indoor heat exchanger 30 is expanded and reduced in pressure by the expansion device 31 to change into low-temperature and low-pressure two-phase gas-liquid refrigerant. The refrigerant then flows into the outdoor heat exchanger 10.

The two-phase gas-liquid refrigerant that has flowed into the outdoor heat exchanger 10 exchanges heat with outdoor air supplied by the outdoor fan 36, receives heat from the outdoor air, and thus evaporates to change into the low-temperature and low-pressure gas refrigerant. The refrigerant then flows out of the outdoor heat exchanger 10.

The low-temperature and low-pressure gas refrigerant is re-sucked into the compressor 33. The refrigerant is re-compressed and discharged from the compressor 33. The above circulation of the refrigerant is repeated.

Operation of Air-conditioning Apparatus 100 in Cooling Operation

Figure 2:
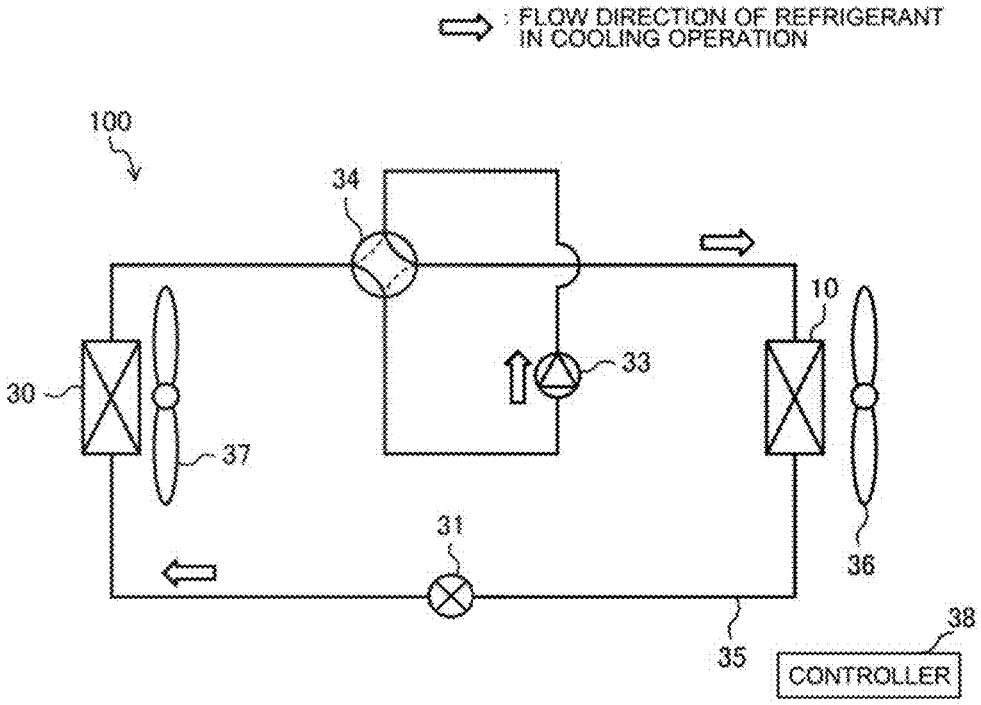
FIG. 2 illustrates the configuration of the refrigerant circuit of the air-conditioning apparatus according to Embodiment 1 and indicates the flow direction of the refrigerant in a cooling operation.

FIG. 2 illustrates the configuration of the refrigerant circuit of the air-conditioning apparatus 100 according to Embodiment 1 and indicates the flow direction of the refrigerant in the cooling operation. In FIG. 2, arrows indicate the flow direction of the refrigerant in the cooling operation.

As illustrated in FIG. 2, low-temperature and low-pressure gas refrigerant is sucked into the compressor 33, and is changed into high-temperature and high-pressure gas refrigerant. The high-temperature and high-pressure gas refrigerant is discharged from the compressor 33 and then passes through the four-way valve 34. After that, the refrigerant flows into the outdoor heat exchanger 10.

The high-temperature and high-pressure gas refrigerant that has flowed into the outdoor heat exchanger 10 exchanges heat with air supplied by the outdoor fan 36, transfers heat to the air, and thus condenses and liquefies to change into high-temperature and high-pressure liquid refrigerant. The high-temperature and high-pressure liquid refrigerant then flows out of the outdoor heat exchanger 10.

The liquid refrigerant that has flowed out of the outdoor heat exchanger 10 is expanded and reduced in pressure by the expansion device 31 to change into low-temperature and low-pressure two-phase gas-liquid refrigerant. The low-temperature and low-pressure two-phase gas-liquid refrigerant then flows into the indoor heat exchanger 30.

The two-phase gas-liquid refrigerant that has flowed into the indoor heat exchanger 30 exchanges heat with indoor air supplied by the indoor fan 37, receives heat from the indoor air, and thus evaporates to change into low-temperature and low-pressure gas refrigerant. The low-temperature and low-pressure gas refrigerant then flows out of the indoor heat exchanger 30.

The low-temperature and low-pressure gas refrigerant is re-sucked into the compressor 33. The refrigerant is re-compressed and discharged from the compressor 33. The above circulation of the refrigerant is repeated.

The number of indoor heat exchangers 30 connected and the number of outdoor heat exchangers 10 connected are not limited to those illustrated in FIGS. 1 and 2 and may be determined for a target in which the refrigeration cycle apparatus is installed.

Operation of Air-Conditioning Apparatus 100 in Defrosting Operation

The flow of refrigerant in the defrosting operation is similar to that in a refrigerant operation, and will thus be described with reference to FIG. 2. As illustrated in FIG. 2, low-temperature and low-pressure gas refrigerant is sucked into the compressor 33, and is changed into high-temperature and high-pressure gas refrigerant. The high-temperature and high-pressure gas refrigerant is discharged from the compressor 33 and then passes through the four-way valve 34. After that, the refrigerant flows into the outdoor heat exchanger 10.

The high-temperature and high-pressure gas refrigerant that has flowed into the outdoor heat exchanger 10 exchanges heat with air supplied by the outdoor fan 36 and frost on an outer surface of the outdoor heat exchanger 10, transfers heat to the air and the frost, and thus condenses and liquefies to change into high-temperature and high-pressure liquid refrigerant. The refrigerant then flows out of the outdoor heat exchanger 10.

The liquid refrigerant that has flowed out of the outdoor heat exchanger 10 is expanded and reduced in pressure by expansion device 31 to change into low-temperature and low-pressure two-phase gas-liquid refrigerant. The two-phase gas-liquid refrigerant then flows into the indoor heat exchanger 30.

The two-phase gas-liquid refrigerant that has flowed into the indoor heat exchanger 30 exchanges heat with indoor air supplied by the indoor fan 37, receives heat from the indoor air, and thus evaporates to change into low-temperature and low-pressure gas refrigerant. The low-temperature and low-pressure gas refrigerant then flows out of the indoor heat exchanger 30.

The low-temperature and low-pressure gas refrigerant is re-sucked into the compressor 33. The refrigerant is re-compressed and discharged from the compressor 33. The above circulation of the refrigerant is repeated.

The number of indoor heat exchangers 30 connected and the number of outdoor heat exchangers 10 connected are not limited to those as illustrated in FIGS. 1 and 2 and may be determined depending on a target at which the refrigeration cycle apparatus is installed.

Configuration of Outdoor Heat Exchanger 10

Figure 3:
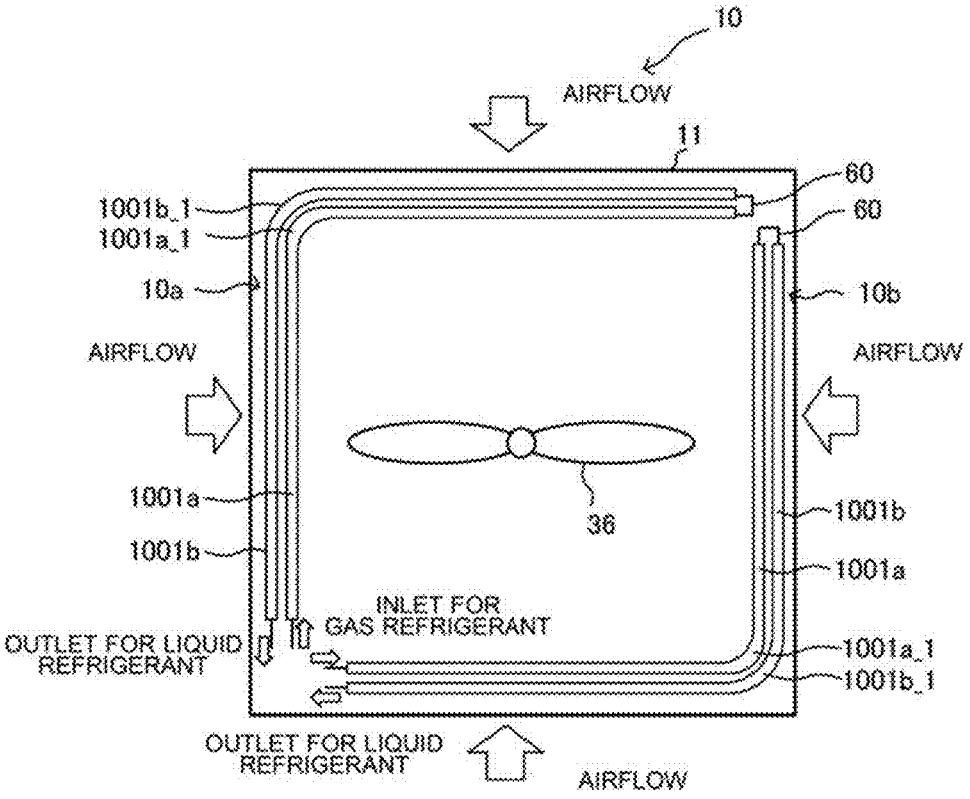
FIG. 3 illustrates the layout of first and second heat exchangers of each of first and second outdoor heat exchanges as the outdoor heat exchanger according to Embodiment 1 is viewed from above.
Figure 4:
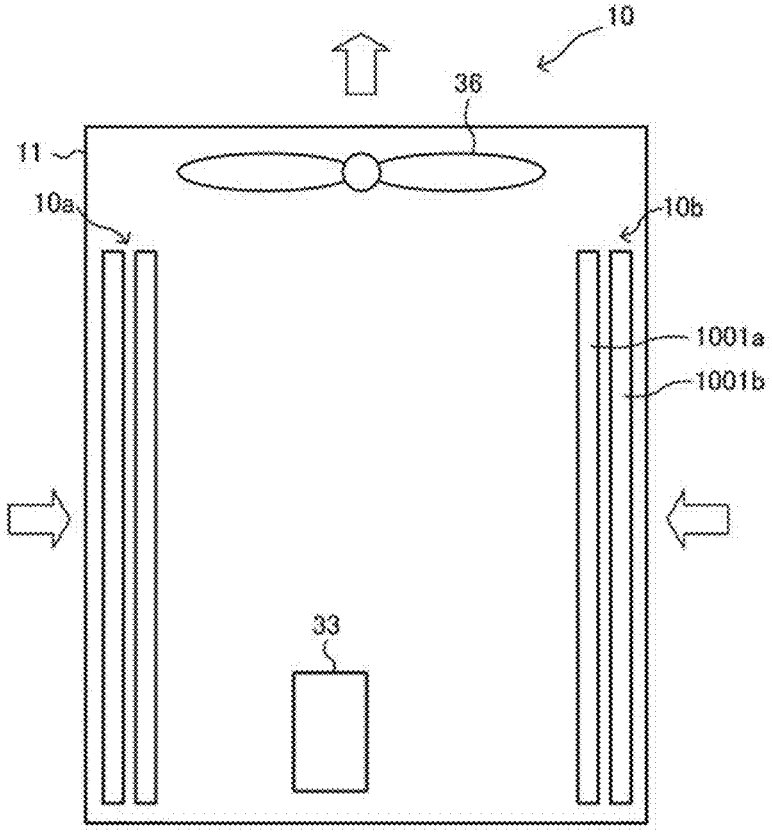
FIG. 4 illustrates the layout of the first and second heat exchangers of each of the first and second outdoor heat exchangers as illustrated in FIG. 3, as a housing is viewed in a horizontal direction.

FIG. 3 illustrates the layout of a first heat exchanger 1001*a* and a second heat exchanger 1001*b* of a first outdoor heat exchanger 10*a* and those of a second outdoor heat exchanger 10*b* as the outdoor heat exchanger 10 according to Embodiment 1 is viewed from above. FIG. 4 illustrates the layout of the first heat exchanger 1001*a* and the second heat exchanger 1001*b* of the first outdoor heat exchanger 10*a* and those of the second outdoor heat exchanger 10*b* as illustrated in FIG. 3, as a housing 11 is viewed in a horizontal direction.

Figure 5:
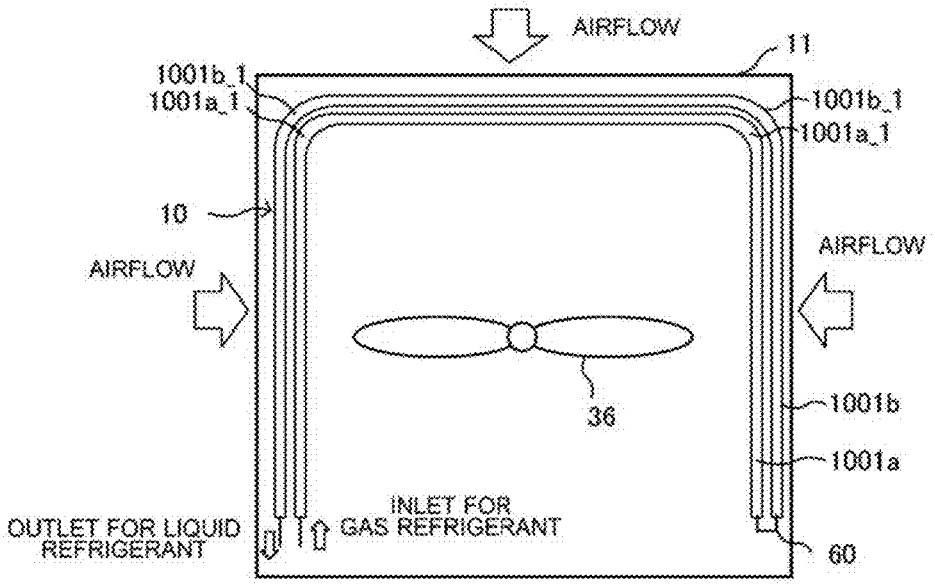
FIG. 5 illustrates a modification of the layout of the first and second heat exchangers as the outdoor heat exchanger according to Embodiment 1 is viewed from above.

FIG. 5 illustrates a modification of the layout of the first heat exchanger 1001*a* and the second heat exchanger 1001*b* as the outdoor heat exchanger 10 according to Embodiment 1 is viewed from above.

Figure 6:
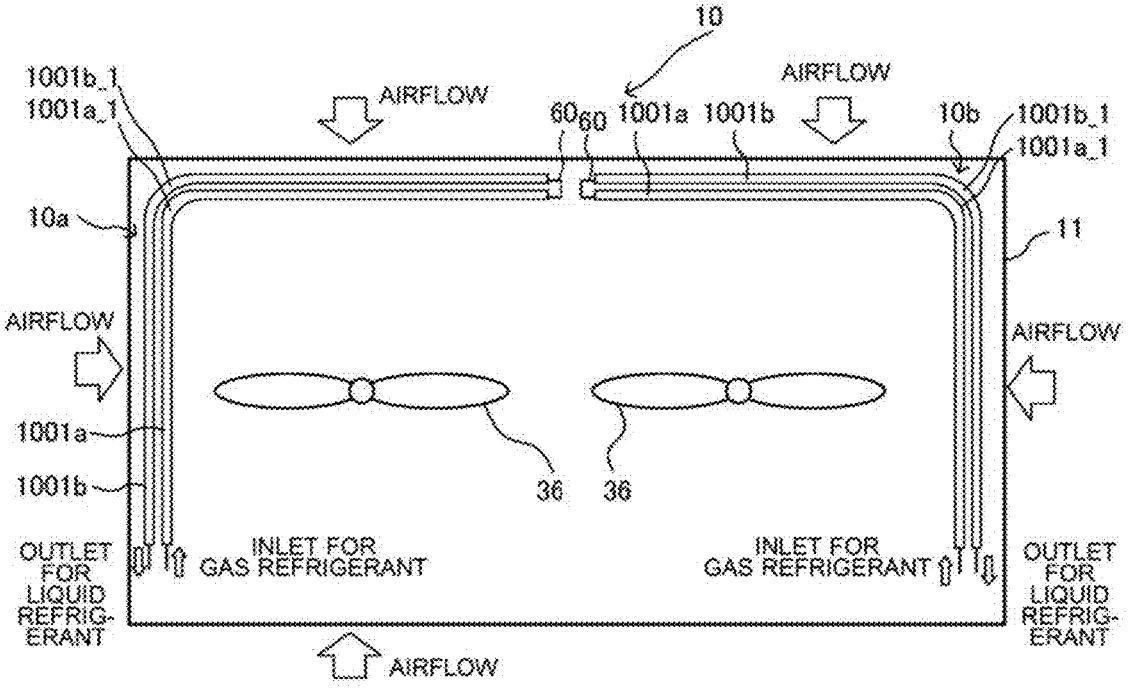
FIG. 6 illustrates a modification of the layout of the outdoor heat exchangers as the outdoor heat exchanger according to Embodiment 1 is viewed from above.

FIG. 6 illustrates a modification of the layout of the first outdoor heat exchanger 10*a* and the second outdoor heat exchanger 10*b* as the outdoor heat exchanger 10 according to Embodiment 1 is viewed from above. In FIGS. 3, 4, 5, and 6, arrows indicate the flow direction of the refrigerant and the flow direction along the airflow.

FIGS. 3, 4, 5, and 6 illustrate the layout of the outdoor heat exchanger 10 and the outdoor fan 36 in the housing of a top-flow type, in which air is blown vertically upward from the housing 11. As illustrated in FIG. 4, the outdoor fan 36 is provided at the top of the housing 11. For example, the compressor 33 is provided in a lower portion of the housing 11.

In the following description, the outdoor heat exchanger 10 may be interchanged with the indoor heat exchanger 30. The outdoor heat exchanger 10 and the indoor heat exchanger 30 may also be simply referred to as heat exchangers.

The outdoor heat exchanger 10 as illustrated in each of FIGS. 3, 4, 5, and 6 is L-shaped in the horizontal direction. The housing 11 of the outdoor unit is polygonal (rectangular in FIGS. 3, 4, 5, and 6) as viewed from above. The outdoor heat exchanger 10 has straight portions that extend along sides of the housing 11 as viewed from above, and bent portions 1001*a*_1 and 1001*b*_1 located at corners and connecting the sides of the housing 11. In general, the bent portions are substantially arc-shaped.

Specifically, the outdoor heat exchanger 10 includes flat portions that extend along side surfaces of the housing 11 and curved portions that are parts of substantially arc faces. In other words, in the outdoor heat exchanger 10, the bent portion 1001*a*_1 and the bent portion 1001*b*_1 are bent around an axis which extends in a vertical direction.

In the case where the housing 11 is a top flow housing, a surface of the housing 11 that faces the outdoor heat exchanger 10 is open such that air is taken from the outside toward the outdoor heat exchanger 10. In the top flow housing, outdoor air is taken thereinto through the open surface facing the outdoor heat exchanger 10 and is then discharged upward from the outdoor fan 36 at the top of the housing.

The outdoor heat exchanger 10 may be provided to face all of surfaces of the housing 11. The outdoor heat exchanger 10 may be provided to face some of the surfaces of the housing 11. Referring to FIG. 3, a first outdoor heat exchanger 10*a* and a second outdoor heat exchanger 10*b* face four surfaces of the housing 11 which is rectangular. Referring to FIG. 5, the outdoor heat exchanger 10 faces three surfaces of the rectangular housing 11. Referring to FIG. 6, the first outdoor heat exchanger 10*a* and the second outdoor heat exchanger 10*b* of the outdoor heat exchanger 10 face three surfaces of the rectangular housing 11 in which two outdoor fans 36 are provided.

FIGS. 3 and 6 illustrate configurations of the outdoor heat exchanger 10 in each of which the first heat exchanger includes one L-shaped bent portion 1001*a*_1 and the second heat exchanger includes one L-shaped bent portion 1001*b*_1. FIG. 5 illustrates a configuration of the outdoor heat exchanger 10 in which the first heat exchanger includes two L-shaped bent portions 1001*a*_1 and the second heat exchanger includes two L-shaped bent portions 1001*b*_1. The first heat exchanger may include three or more L-shaped bent portions 1001*a*_1, and the second heat exchanger may include three or more L-shaped bent portions 1001*b*_1. Referring to FIG. 3, the first outdoor heat exchanger 10*a* including one L-shaped bent portion 1001*a*_1 and one L-shaped bent portion 1001*b*_1 is provided, and the second outdoor heat exchanger 10*b* including one L-shaped bent portion 1001*a*_1 and one L-shaped bent portion 1001*b*_1 is provided. The number of bent portions 1001*a*_1 and the number of bent portions 1001*b*_1 in the first outdoor heat exchanger 10*a* and the second outdoor heat exchanger 10*b* may be changed, and the positions of these bent portions in the first outdoor heat exchanger 10*a* and the second outdoor heat exchanger 10*b* may be changed.

The outdoor heat exchanger 10 as illustrated in each of FIGS. 3, 4, 5, and 6 includes the first and second heat exchangers 1001*a* and 1001*b* arranged in the flow direction along an airflow produced by the outdoor fan 36. As illustrated in FIGS. 3, 4, 5, and 6, in examples illustrated in these figures, the first heat exchanger 1001*a* is provided downstream of the second heat exchanger 1001*b* in the flow direction of the airflow. That is, the first heat exchanger 1001*a* is located inward of the second heat exchanger 1001*b* in the housing 11, and is located adjacent to the second heat exchanger 1001*b* such that the first heat exchanger 1001*a* extends in the same manner as the second heat exchanger 1001*b*.

The number of heat exchangers included in the outdoor heat exchanger 10 is not limited to two. The number of heat exchangers may be any number greater than or equal to two. For example, in the case where three heat exchangers are included in the outdoor heat exchanger 10, it suffices that a third heat exchanger is provided in addition to the first heat exchanger 1001*a* and the second heat exchanger 1001*b* such that these three heat exchangers are arranged.

Figure 7:
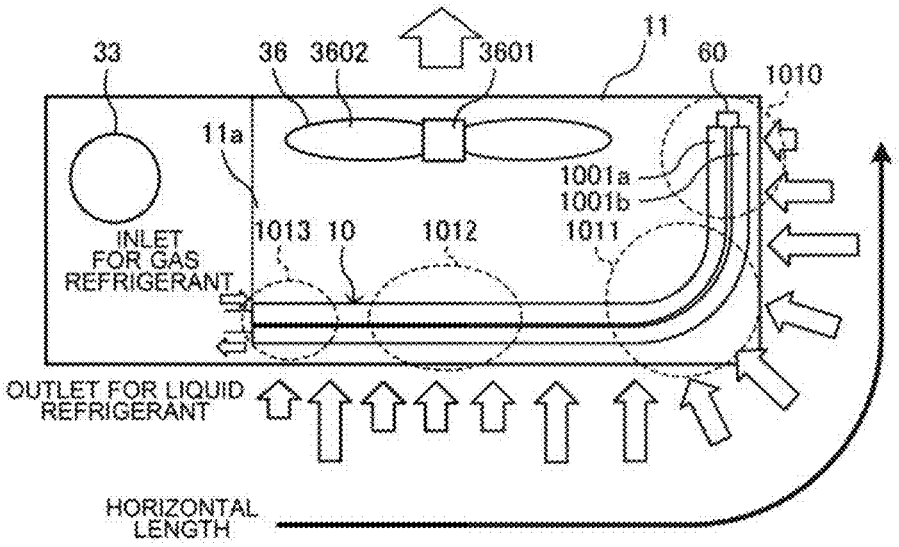
FIG. 7 illustrates the layout of the outdoor heat exchanger and an outdoor fan in the housing of a side-flow type in which air is blown horizontally sideward from the housing of the outdoor heat exchanger according to Embodiment 1.

FIG. 7 illustrates the layout of the outdoor heat exchanger 10 and the outdoor fan 36 in the housing 11 which is a side-flow housing in which air is blown horizontally sideward from the housing 11 of the outdoor heat exchanger 10 according to Embodiment 1. In FIG. 7, outlined arrows indicate the flow direction of airflow and the flow direction of the refrigerant, and an arrow indicates a direction in which a horizontal length from a heat-exchange front area 1013 to a heat-exchange end area 1010 in the housing 11 is measured.

As illustrated in FIG. 7, in the housing 11, the heat-exchange end area 1010, an L-bent area 1011, a boss area 1012, and the heat-exchange front area 1013 are located. The heat-exchange end area 1010 is an area where an outlet 1003*a*_1 of a first header 1003*a* in the first heat exchanger 1001*a* and an inlet 1004*b*_1 of a second header 1004*b* in the second heat exchanger 1001*b* are arranged in the flow direction of the airflow (see FIG. 8). The L-bent area 1011 is an area where the bent portion 1001*a*_1 of the first heat exchanger 1001*a* and the bent portion 1001*b*_1 of the second heat exchanger 1001*b* are located (see FIGS. 3 to 7). The boss area 1012 are areas of the first heat exchanger 1001*a* and the second heat exchanger 1001*b* that face in the horizontal direction, a boss 3601 of the outdoor fan 36 and blades 3602 attached to the boss 3601 and extend along a side surface of the housing 11. The heat-exchange front area 1013 is an area located close to an inlet 1004*a*_1 of a second header 1004*a* in the first heat exchanger 1001*a* and an outlet 1003*b*_1 of a first header 1003*b* in the second heat exchanger 1001*b* (see FIG. 8).

The side-flow housing 11 is configured such that air in the housing 11 is blown out by the outdoor fan 36 provided inward from the side surface of the housing 11. The first heat exchanger 1001*a* and the second heat exchanger 1001*b* each have flat portions extending along the side surfaces of the housing 11 and a curved portion as in the top flow housing 11 described above. In general, the side-flow housing 11 is rectangular as viewed from above, as illustrated in FIG. 7, and the inside of the housing 11 is partitioned into two spaces by a side surface 11*a*. For example, in one of the two spaces in the housing 11, the compressor 33 is provided, and in the other space, the outdoor fan 36 and the outdoor heat exchanger 10 are provided. At the side surface 11*a*, part of the outdoor heat exchanger 10 is located as viewed from above.

The outdoor heat exchanger 10 as illustrated in FIG. 7 includes the first heat exchanger 1001*a* and the second heat exchanger 1001*b* arranged in the flow direction along an airflow produced by the outdoor fan 36. The number of heat exchangers included in the outdoor heat exchanger 10 is not limited to two. The number of heat exchangers may be any number greater than or equal to two. For example, in the case where three outdoor heat exchangers are included in the outdoor heat exchanger 10, it suffices that a third heat exchanger 1001 is provided in addition to the first heat exchanger 1001*a* and the second heat exchanger 1001*b* such that the three heat exchangers are arranged.

Figure 8:
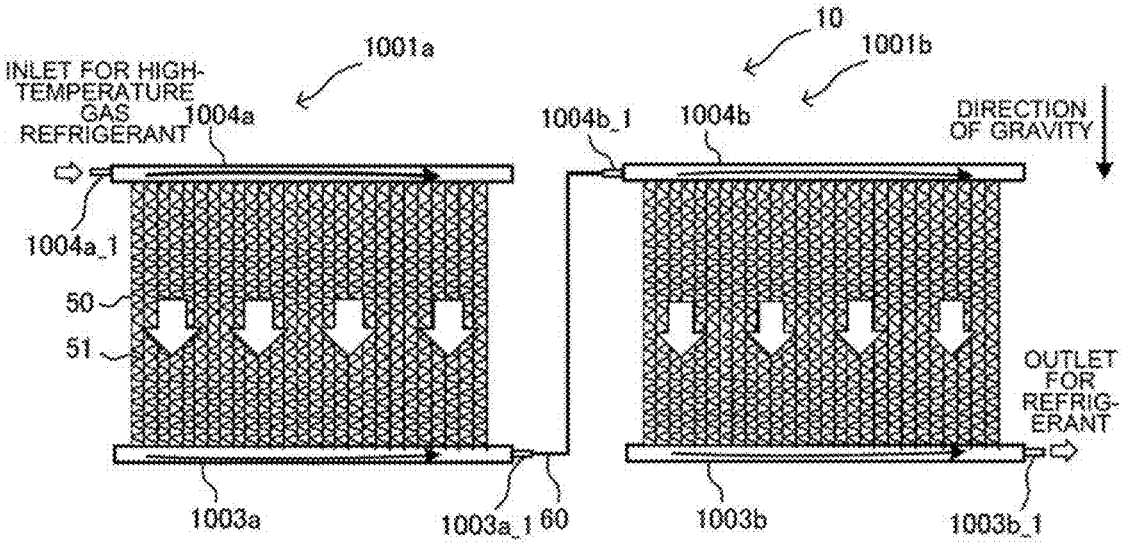
FIG. 8 illustrates the configuration of the outdoor heat exchanger according to Embodiment 1.

FIG. 8 illustrates a configuration of the outdoor heat exchanger 10 according to Embodiment 1. In FIG. 8, outlined arrows indicates the flow direction of the refrigerant in flat tubes 50 in defrosting, and arrows indicates the flow direction of the refrigerant in the first headers 1003 and the second headers 1004 in defrosting, airflows, and the direction of gravity.

The outdoor heat exchanger 10 includes the first heat exchanger 1001*a* and the second heat exchanger 1001*b*. The first heat exchanger 1001*a* and the second heat exchanger 1001*b* each include a plurality of flat tubes 50 (heat transfer tubes) that extend in the vertical direction and spaced apart from each other in the horizontal direction.

The flat tubes 50 of the first heat exchanger 1001*a* have lower ends connected to the first header 1003*a* which is configured to distribute or combine the refrigerant, and upper ends connected to the second header 1004*a* which is configured to distribute or combine the refrigerant. The flat tubes 50 of the second heat exchanger 1001*b* have lower ends connected to the first header 1003*b* which is configured to distribute or combine the refrigerant, and upper ends connected to the second header 1004*b* which is configured to distribute or combine the refrigerant.

Although FIG. 8 illustrates an example in which fins 51 are provided between the flat tubes 50 spaced apart from each other, the fins 51 may be excluded.

The second header 1004*a* has the inlet 1004*a*_1 for the refrigerant in the case where the outdoor heat exchanger 10 operates as a condenser. The first header 1003*a* of the first heat exchanger 1001*a* has the outlet 1003*a*_1 for the refrigerant in the case where the outdoor heat exchanger 10 operates as a condenser.

The second header 1004*b* has the inlet 1004*b*_1 for the refrigerant in the case where the outdoor heat exchanger 10 operates as a condenser. The first header 1003*b* of the second outdoor heat exchanger 10*b* has the outlet 1003*b*_1 for the refrigerant in the case where the outdoor heat exchanger 10 operates as a condenser.

The first heat exchanger 1001*a* and the second heat exchanger 1001*b* are provided along the flow direction along an airflow that passes through spaces between the flat tubes 50 and that is produced by the outdoor fan 36 (see, for example, FIG. 3).

The first heat exchanger 1001*a* is provided downstream of the second heat exchanger 1001*b* in the airflow.

An inter-row connecting pipe 60 connects the outlet 1003*a*_1 of the first header 1003*a* in the first heat exchanger 1001*a* with the inlet 1004*b*_1 of the second header 1004*b* in the second heat exchanger 1001*b*.

The first header 1003*a* and the second header 1004*a* of the first heat exchanger 1001*a* are tubular members that extend in the horizontal direction and are bent in a horizontal plane. As illustrated in FIGS. 3, 5, 6, and 7, the first header 1003*a* and the second header 1004*a* have the bent portions 1001*a*_1 and 1001*b*_1 located between the straight portions as viewed from above.

The first header 1003*b* and the second header 1004*b* of the second heat exchanger 1001*b* are tubular members that extend in the horizontal direction and are bent in the horizontal plane. As illustrated in FIGS. 3, 5, 6, and 7, the first header 1003*b* and the second header 1004*b* have the bent portions 1001*a*_1 and 1001*b*_1 located between the straight portions as viewed from above.

Typically, ends of the first header 1003*a* and the second header 1004*b* are provided close to corners of the housing 11. The inter-row connecting pipe 60 is provided close to a corner in the housing 11 that is far from the inlet 1004*a*_1 and the outlet 1003*b*_1, the inlet 1004*a*_1 being used for gas refrigerant when the outdoor heat exchanger 10 is used as a condenser, the outlet 1003*b*_1 being used for liquid refrigerant, when the outdoor heat exchanger 10 is used as a condenser.

Operation of Outdoor Heat Exchanger 10 Used as Condenser

It will be described how the outdoor heat exchanger 10 is operated when being used as a condenser. It should be noted that the outdoor heat exchanger 10 may be used as an evaporator. When the outdoor heat exchanger 10 is used as an evaporator, the flow direction of the refrigerant is reversed.

When the outdoor heat exchanger 10 is used as a condenser, high-temperature gas refrigerant flows into the second header 1004*a* of the first heat exchanger 1001*a* through the inlet 1004*a*_1 of the second header 1004*a* and is then distributed to the flat tubes 50.

The refrigerant condenses and liquefies while transferring heat to air, collects in the first header 1003*a*, and flows out of the first header 1003*a* through the outlet 1003*b*_1. The refrigerant that has flowed out of the first header 1003*a* through the outlet 1003*b*_1 passes through the inter-row connecting pipe 60 connecting the first header 1003*a* and the second header 1004*b* and flows into the second header 1004*b* of the second heat exchanger 1001*b* through the inlet 1004*b*_1 of the second header 1004*b*. The refrigerant that has flowed into the second header 1004*b* is distributed to the flat tubes 50. The refrigerant condenses and liquefies while transferring heat to the air, collects in the first header 1003*b*, and flows out of the first header 1003*b* through the outlet 1003*b*_1.

Advantages of Outdoor Heat Exchanger 10

In the outdoor heat exchanger 10 according to Embodiment 1, the heat transfer performance is improved because condensing and liquefying refrigerant necessarily flows downward in the flat tubes 50.

Figure 9:
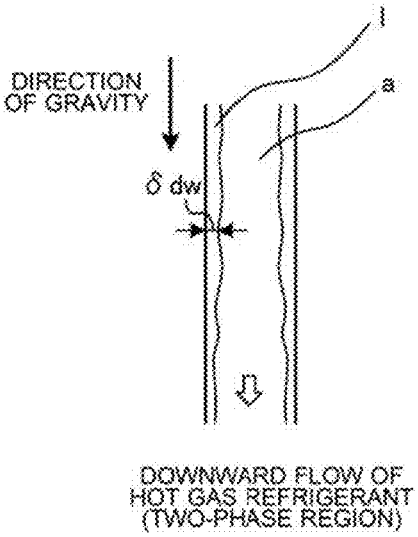
FIG. 9 schematically illustrates a mechanism for improvement of the heat transfer performance in downward flow of two-phase refrigerant in flat tubes of the outdoor heat exchanger according to Embodiment 1.
Figure 10:
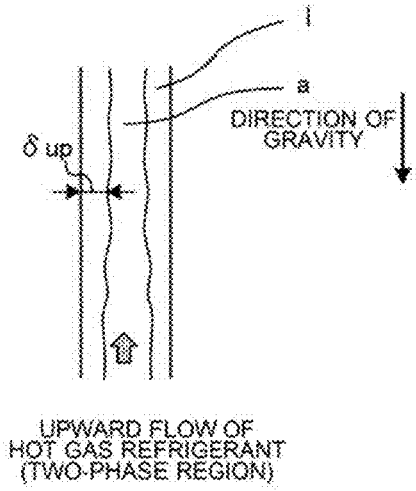
FIG. 10 schematically illustrates a mechanism for improvement of heat transfer performance in upward flow of two-phase refrigerant in the flat tubes of the outdoor heat exchanger according to Embodiment 1.
Figure 11:
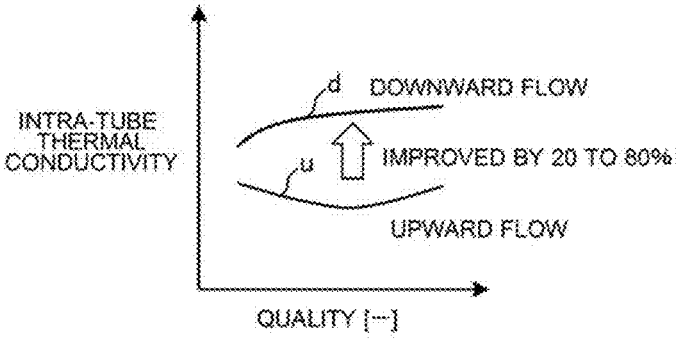
FIG. 11 is a graph indicating a relationship between a quality and a thermal conductivity of an upward refrigerant flow and that of a downward refrigerant flow through the flat tubes of the outdoor heat exchanger according to Embodiment 1.

FIG. 9 schematically illustrates a mechanism for improvement of the heat transfer performance in downward flow of two-phase refrigerant in the flat tubes 50 of the outdoor heat exchanger 10 according to Embodiment 1. FIG. 10 schematically illustrates a mechanism for improvement of the heat transfer performance in upward flow of two-phase refrigerant in the flat tubes 50 of the outdoor heat exchanger 10 according to Embodiment 1. In FIGS. 9 and 10, outlined arrows indicate the flow direction of hot gas refrigerant. FIG. 11 is a graph indicating a relationship between a quality and a thermal conductivity of refrigerant that flows upwards through the flat tubes 50 of the outdoor heat exchanger 10 according to Embodiment 1 and a relationship between a quality and a thermal conductivity of refrigerant that flows downward through the flat tubes 50 of the outdoor heat exchanger 10.

FIG. 10 shows that the thickness of a liquid film is increased when a liquid film velocity is reduced because of the effect of gravity in the case where hot gas refrigerant flows upward through the flat tubes 50 while condensing and liquefying. A liquid film thickness δdw of two-phase refrigerant that flows downward as illustrated in FIG. 9 is smaller than a liquid film thickness δup of two-phase refrigerant that flows upward as illustrated in FIG. 10. As illustrated in FIG. 11, the intra-tube thermal conductivity of the refrigerant that flows downward, downward flow d, is higher than that of the refrigerant that flows upward, upward flow u, by 20% to 80%.

Therefore, according to Embodiment 1, since the refrigerant flows downward through the flat tubes 50 of the outdoor heat exchanger 10 when condensing and liquefying, the heat exchanger performance in the cooling operation and the defrosting performance in the defrosting operation are improved. In particular, because of improvement of the defrosting performance in the defrosting operation, it is possible to promptly melt frost on the flat tubes 50 and the fins 51. Accordingly, it is possible to more promptly return the operation from the defrosting operation to the heating operation, thereby improving the heating capacity.

The following description is made with respect to a configuration that is applied in the case where in the defrosting operation, the refrigerant is made to flow from the first header 1003 located on a lower side, not from the second header 1004 located on an upper side as in the outdoor heat exchanger 10 according to Embodiment 1.

The refrigerant distributed from the first header 1003 to the flat tubes 50 flows upward while condensing and liquefying by transferring heat to frost on the flat tubes 50 and the fins 51. In the flat tubes 50, the refrigerant flows upward against gravity that acts vertically downward. As a result, in some of the flat tubes 50, the refrigerant that has liquefied and become high-density fails to flow upward and accumulates in the flat tubes 50. In the flat tubes 50 in which such liquid accumulation occurs, heat is hardly transferred between the refrigerant and the frost. Inevitably, the frost remains without melting.

Figure 12:
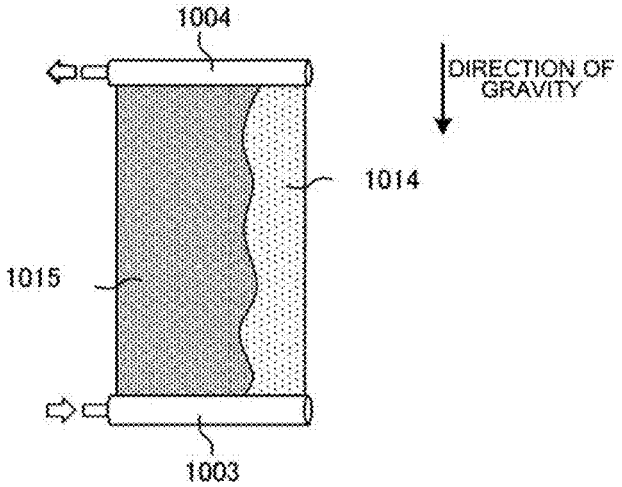
FIG. 12 is a schematic diagram for explanation of a liquid accumulation area in the flat tubes and fins in the case where the refrigerant flows upward.
Figure 13:
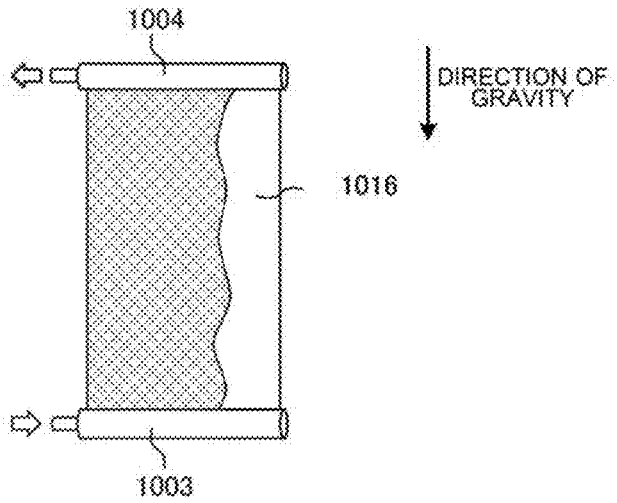
FIG. 13 is a schematic diagram for explanation of a residual frost area in the flat tubes and the fins in the case where the refrigerant flows upward.

FIG. 12 is a schematic diagram for explanation of a liquid accumulation area in the flat tubes 50 and the fins 51 in the case where the refrigerant flows upward. FIG. 13 is a schematic diagram for explanation of a residual frost area 1016 in the flat tubes 50 and the fins 51 in the case where the refrigerant flows upward. FIG. 12 illustrates a liquid accumulation area 1014 and a hot-gas flux area 1015. FIG. 13 illustrates the residual frost area 1016. As illustrated in FIGS. 12 and 13, the liquid accumulation area 1014 has a low heat exchange capacity and thus becomes the residual frost area 1016. The liquid accumulation area 1014 will increase defrosting time, reduce the heating capacity, and cause the frost to remain without melting, thus causing quality issues.

Figure 14:
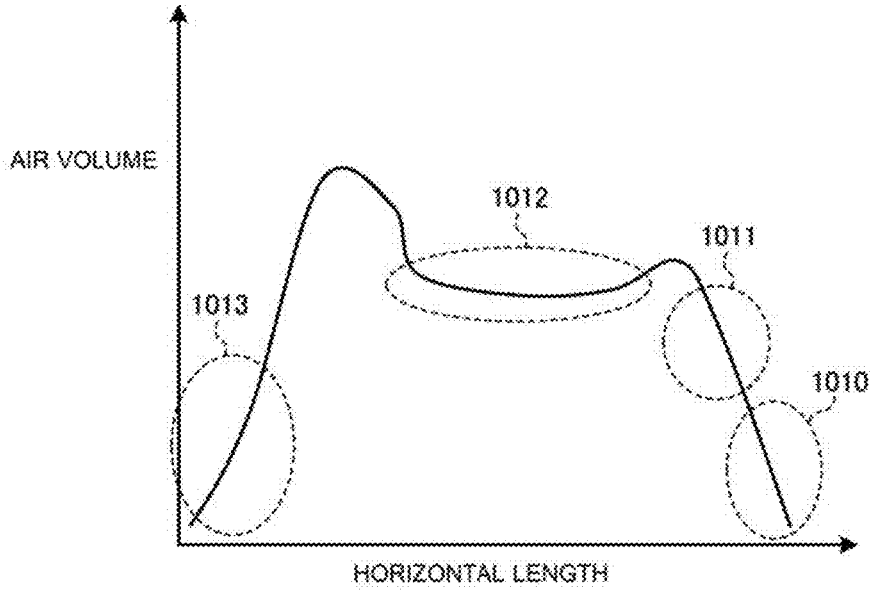
FIG. 14 is a graph indicating an air volume distribution relative to a horizontal length of the side-flow housing as illustrated in FIG. 7 in the case where the housing of the outdoor heat exchanger according to Embodiment 1 is the side-flow housing as illustrated in FIG. 7.

FIG. 14 is a graph indicating an air volume distribution relative to the horizontal length of the housing 11 as illustrated in FIG. 7 in the case where the housing 11 of the outdoor heat exchanger 10 according to Embodiment 1 is the side-flow housing 11 as illustrated in FIG. 7.

In the case where the outdoor fan 36 is of a side-flow type as illustrated in FIG. 7, the flow volume of air that passes through the outdoor heat exchanger 10 has a distribution as illustrated in FIG. 14. In the heat-exchange end area 1010 and the heat-exchange front area 1013, the air volume is small. Inevitably, the heat-exchange end area 1010 and the heat-exchange front area 1013 each have a low heat exchanger performance.

In Embodiment 1, in the case where the outdoor fan 36 is of a side-flow type, the inter-row connecting pipe 60 connecting the first heat exchanger 1001*a* and the second heat exchanger 1001*b* is provided in the heat-exchange end area 1010 as illustrated in FIG. 7. Essentially, because of provision of the inter-row connecting pipe 60, a lateral dimension of the outdoor heat exchanger 10 (the horizontal lengths of the first and second headers 1003 and 1004) is reduced, thus reducing the heat exchanger performance. However, because the inter-row connecting pipe 60 is provided in the heat-exchange end area 1010 where the air volume rate is locally reduced, it is possible to minimize reduction of the heat exchanger performance. Thus, a cost reduction effect that is obtained by a decrease in the size of the heat exchanger outweighs reduction of the heat exchanger performance, thus improving the cost performance ratio.

Embodiment 2

Embodiment 2 will be described below. In Embodiment 2, components that are described above regarding Embodiment 1 will not be re-described, and components that are the same as or equivalent to those in Embodiment 1 will be denoted by the same reference signs.

Figure 15:
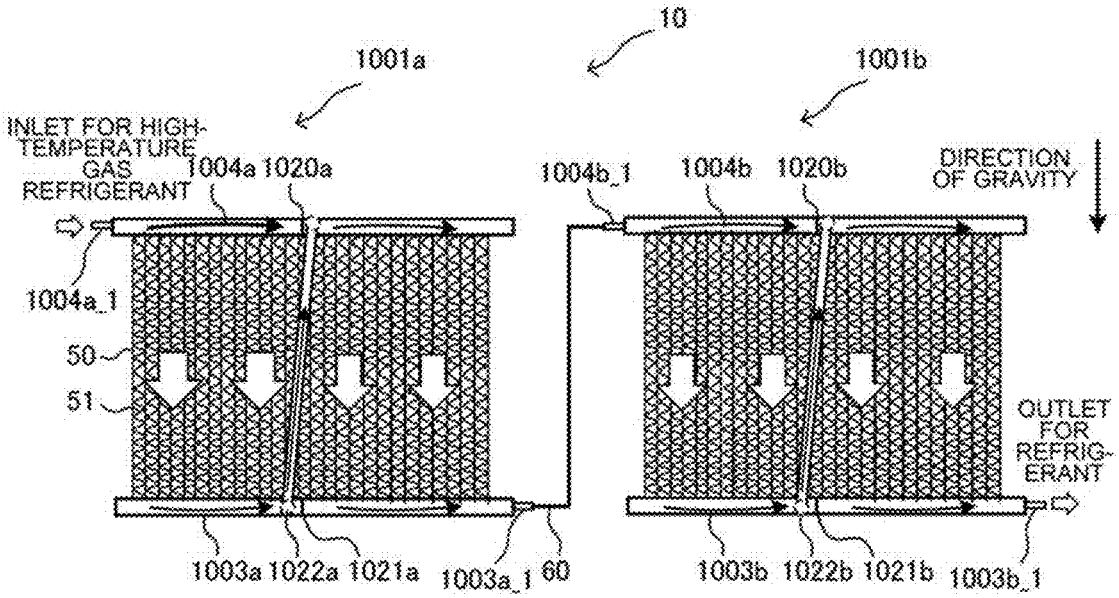
FIG. 15 illustrates a configuration of an outdoor heat exchanger according to Embodiment 2.

FIG. 15 illustrates a configuration of the outdoor heat exchanger 10 according to Embodiment 2. In FIG. 15, outlined arrows indicate the flow direction of the refrigerant, and arrows indicate the flow of the refrigerant in defrosting, airflows, and the direction of gravity.

In the outdoor heat exchanger 10 according to Embodiment 2, as illustrated in FIG. 15, the second header 1004*a* of the first heat exchanger 1001*a* is partitioned into right and left spaces by a first partition 1020*a*, and the inside of the first header 1003*a* is partitioned into right and left spaces by a second partition 1021*a*. A top-bottom connecting pipe 1022*a* is provided to connect the left space located on the left side relative to the second partition 1021*a* in the first header 1003*a* and the right space located on the right side relative to the first partition 1020*a* in the second header 1004*a*. That is, the top-bottom connecting pipe 1022*a* connects an upstream space (left space) in the first header 1003*a* and a downstream space (right space) in the second header 1004*a*.

The inside of the second header 1004*b* of the second heat exchanger 1001*b* is partitioned into right and left sides by a first partition 1020*b*, and the inside of the first header 1003*b* is partitioned into right and left spaces by a second partition 1021*b*. A top-bottom connecting pipe 1022*b* is provided to connect the left space located on the left side relative to the second partition 1021*b* in the first header 1003*b* and the right space located on the right side relative to the first partition 1020*b* in the second header 1004*b*. That is, the top-bottom connecting pipe 1022*b* connects an upstream space (left space) in the first header 1003*b* and a downstream space (right space) in the second header 1004*b*.

The refrigerant that has flowed into the second header 1004*a* is distributed to the flat tubes 50, collects in the first header 1003*a*, flows through the top-bottom connecting pipe 1022*a*, and re-flows into the second header 1004*a*. The refrigerant is then distributed to the flat tubes 50, re-collects in the first header 1003*a*, and flows out of the first header 1003*a*.

The refrigerant that has flowed out of the first header 1003*a* passes through the inter-row connecting pipe 60 and flows into the second header 1004*b*. The refrigerant that has flowed into the second header 1004*b* of the second heat exchanger 1001*b* through the inter-row connecting pipe 60 flows through the second header 1004*b*, the flat tubes 50, the first header 1003*b*, the top-bottom connecting pipe 1022*b*, the second header 1004*b*, the flat tubes 50, and the first header 1003*b* in this order as in the first outdoor heat exchanger 10*a*, and then flows out of the second heat exchanger 1001*b*.

In the outdoor heat exchanger 10 according to Embodiment 2, the inside of each of the first headers 1003*a* and 1003*b* is partitioned into spaces, and the inside of each of the second headers 1004*a* and 1004*b* is partitioned into spaces, and as a result, the flow velocity of refrigerant that flows through the flat tubes 50 is increased, thereby improving the thermal conductivity. Therefore, the heat exchanger performance in the cooling operation is improved and the defrosting performance in the defrosting operation is improved. In particular, because of improvement of the defrosting performance in the defrosting operation, it is possible to promptly melt frost on the flat tubes 50 and the fins 51, and thus more promptly return the operation from the defrosting operation to the heating operation, thereby improving the heating capacity.

Figure 16:
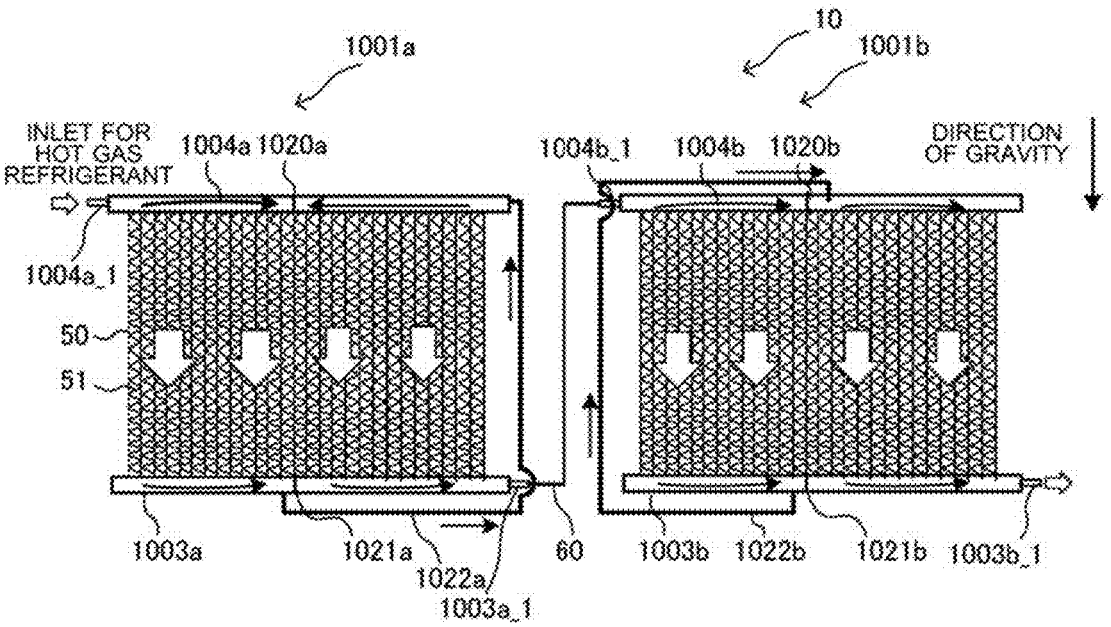
FIG. 16 illustrates a configuration of a modification of the outdoor heat exchanger according to Embodiment 2.

FIG. 16 illustrates a configuration of a modification of the outdoor heat exchanger 10 according to Embodiment 2.

As illustrated in FIG. 16, the inside of the second header 1004*a* of the first heat exchanger 1001*a* is partitioned into right and left spaces by the first partition 1020*a*, and the inside of the first header 1003*a* is partitioned into right and left spaces by the second partition 1021*a*. The top-bottom connecting pipe 1022*a* is provided to connect the left space located on the left side relative to the second partition 1021*a* in the first header 1003*a* and the right space located on the right side relative to the first partition 1020*a* in the second header 1004*a*. That is, the top-bottom connecting pipe 1022*a* connects the upstream space (left space) in the first header 1003*a* and the downstream space (right space) in the second header 1004*a*.

The inside of the second header 1004*b* of the second heat exchanger 1001*b* is partitioned into right and left spaces by the first partition 1020*b*, and the first header 1003*b* is partitioned into right and left spaces by the second partition 1021*b*. The top-bottom connecting pipe 1022*b* is provided to connect the left space located on the left side relative to the second partition 1021*b* in the first header 1003*b* and the right space located on the right side relative to the first partition 1020*b* in the second header 1004*b*. That is, the top-bottom connecting pipe 1022*b* connects the upstream space (left space) in the first header 1003*b* and the downstream space (right space) in the second header 1004*b*.

As illustrated in FIG. 16, part of the top-bottom connecting pipe 1022*a* is provided along the first header 1003*a*. The top-bottom connecting pipe 1022*a* connects the left space located on the left side relative to the second partition 1021*a* in the first header 1003*a* and the right space located on the right side relative to the first partition 1020*a* in the second header 1004*a*.

Part of the top-bottom connecting pipe 1022*b* is provided along the first header 1003*b*. The top-bottom connecting pipe 1022*b* connects the left space located on the left side relative to the second partition 1021*b* in the first header 1003*b* and the right space located on the left side relative to the first partition 1020*b* in the second header 1004*b*.

In Embodiment 2, the top-bottom connecting pipe 1022*a* and the top-bottom connecting pipe 1022*b* are not located in such a manner as to intersect the flat tubes 50. Thus, the top-bottom connecting pipe 1022*a* and the top-bottom connecting pipe 1022*b* do not obstruct airflows. Accordingly, the heat exchanger performance is improved.

Embodiment 3

Embodiment 3 will be described below. In Embodiment 3, components that are described above regarding Embodiment 1 or Embodiment 2 will not be re-described, and components that are the same as or equivalent to those in Embodiment 1 and/or Embodiment 2 will be denoted by the same reference signs.

Figure 17:
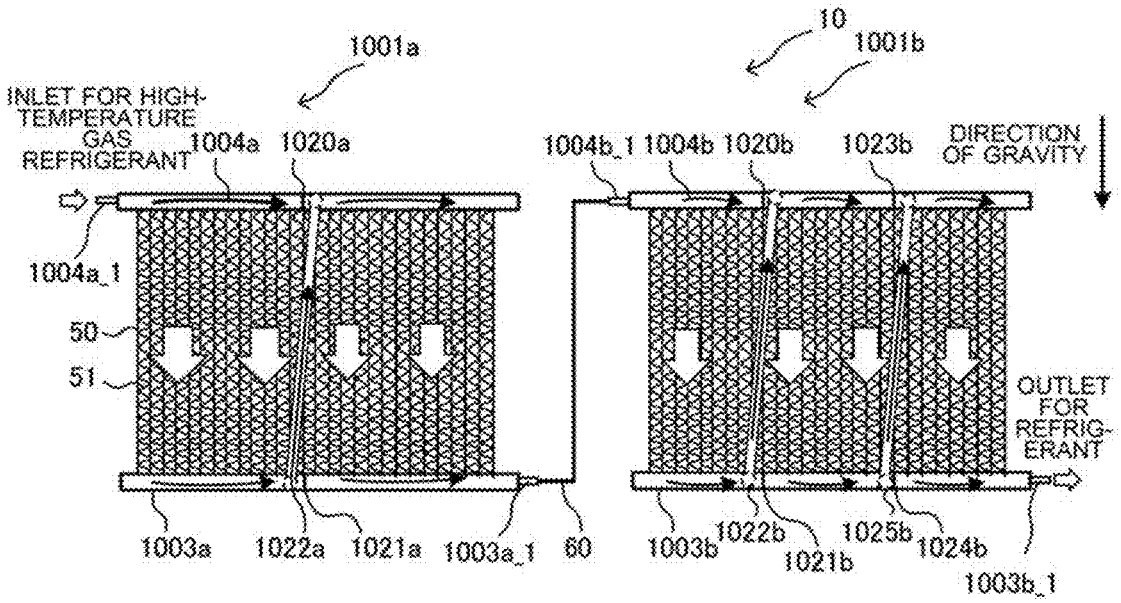
FIG. 17 illustrates a configuration of an outdoor heat exchanger according to Embodiment 3.

FIG. 17 illustrates a configuration of the outdoor heat exchanger 10 according to Embodiment 3.

In the outdoor heat exchanger 10 according to Embodiment 3, a top-bottom connecting pipe 1022*b*_1 and a top-bottom connecting pipe 1022*b*_2 are provided between the first header 1003*b* and the second header 1004*b* of the second heat exchanger 1001*b* located on a windward side. The top-bottom connecting pipe 1022*a* is provided between the first header 1003*a* and the second header 1004*a* of the first heat exchanger 1001*a* located on a leeward side.

In the outdoor heat exchanger 10 according to Embodiment 3, as illustrated in FIG. 17, the number of top-bottom connecting pipes 1022*b* in the second heat exchanger 1001*b* located on the windward side is larger than that in the first heat exchanger 1001*a*.

As a result, the flow velocity of liquid refrigerant that flows through the flat tubes 50 of the second heat exchanger 1001*b* on the windward side is increased, and the thermal conductivity is thus improved. Therefore, the heat exchanger performance in the cooling operation is improved, and the defrosting performance in the defrosting operation is improved. In particular, because of improvement of the defrosting performance in the defrosting operation, it is possible to promptly melt frost on the flat tubes 50 and the fins 51, and thus more promptly return the operation from the defrosting operation to the heating operation, thereby improving the heating capacity.

Embodiment 4

Embodiment 4 will be described below. In Embodiment 4, components that are described above regarding any of Embodiments 1 to 3 will not be re-described, and components that are the same as or equivalent to those in any of Embodiments 1 to 3 will be denoted by the same reference signs.

FIG. 18 illustrates a configuration of the outdoor heat exchanger 10 according to Embodiment 4.

In Embodiment 4, the flow control valve 1026 is provided to adjust the flow rate of refrigerant that is supplied to the first heat exchanger 1001*a* and the second heat exchanger 1001*b*.

As illustrated in FIG. 18, the flow control valve 1026 is provided at an upstream pipe 1201 located upstream of the refrigerant inlet 1004*a*_1 of the second header 1004*a* in the first heat exchanger 1001*a* and is configured to adjust the flow rate of refrigerant that flows into the refrigerant inlet 1004*a*_1 of the second header 1004*a*.

The refrigerant inlet 1004*b*_1 of the second header 1004*b* in the second heat exchanger 1001*b* is connected to a branch pipe 1202 that branches off from the upstream pipe 1201 which is located upstream of the flow control valve 1026. As illustrated in FIG. 18, the refrigerant branches into refrigerant streams at a position located upstream of the first heat exchanger 1001*a* and the second heat exchanger 1001*b*, and the refrigerant streams flow in parallel through the first heat exchanger 1001*a* and the second heat exchanger 1001*b*.

The flow control valve 1026 is controlled by the controller 38 (see FIG. 1). The controller 38 controls the flow control valve 1026 in the defrosting operation or the cooling operation such that the flow rate of refrigerant that flows into the refrigerant inlet 1004*a*_1 of the second header 1004*a* in the first heat exchanger 1001*a* is lower than the flow rate of refrigerant that flows into the refrigerant inlet 1004*b*_1 of the second header 1004*b* in the second heat exchanger 1001*b*.

In the outdoor heat exchanger 10 according to Embodiment 4, it is possible to decrease the flow rate of refrigerant in the first heat exchanger 1001*a* located on the leeward side and increase the flow rate of refrigerant in the second heat exchanger 1001*b* located on the windward side. A larger amount of frost can adhere to the flat tubes 50 and the fins 51 of the second heat exchanger 1001*b* located on the windward side. Thus, by causing a larger amount of refrigerant to flow through the second heat exchanger 1001*b* to which a larger amount of frost adheres, it is possible to more promptly complete defrosting and improve the heating capacity.

REFERENCE SIGNS LIST

10: outdoor heat exchanger, 10*a*: first outdoor heat exchanger, 10*b*: second outdoor heat exchanger, 11: housing, 11*a*: side surface, 30: indoor heat exchanger, 31: expansion device, 33: compressor, 34: four-way valve, 35: refrigerant pipe, 36: outdoor fan, 37: indoor fan, 38: controller, 50: flat tube, 51: fin, 60: inter-row connecting pipe, 100: air-conditioning apparatus, 1001*a*: first heat exchanger, 1001*b*: second heat exchanger, 1001*a*_1, 1001*b*_1: bent portion, 1003, 1003*a*, 1003*b*: first header, 1003*a*1, 1003*b*1: outlet, 1004, 1004*a*, 1004*b*: second header, 1004*a*1, 1004*b*1: inlet, 1010: heat-exchange end area, 1011: L-bent area, 1012: boss area, 1013: heat-exchange front area, 1014: liquid accumulation area, 1015: hot-gas flux area, 1016: residual frost area, 1020*a*, 1020*b*: first partition, 1021*a*, 1021*b*: second partition, 1022*a*, 1022*b*, 1022*b*_1, 1022*b*_2: top-bottom connecting pipe, 1023*b*: third partition, 1024*b*: fourth partition, 1026: flow control valve, 1201: upstream pipe, 1202: branch pipe, 3601: boss, 3602: blade, 1: liquid, a: gas, d: downward flow, u: upward flow

The invention claimed is:

1. A heat exchanger comprising:

a first heat exchanger and a second heat exchanger each including a plurality of heat transfer tubes extending in a vertical direction and spaced apart from each other in a horizontal direction, a first header located at lower ends of the plurality of heat transfer tubes, having an outlet for refrigerant, and configured to distribute or combine the refrigerant, and a second header located at upper ends of the plurality of heat transfer tubes, having an inlet for the refrigerant, and configured to distribute or combine the refrigerant; and an inter-row connecting pipe connecting the outlet of the first header in the first heat exchanger and the inlet of the second header in the second heat exchanger, wherein in a polygonal housing, the first heat exchanger and the second heat exchanger are arranged in a flow direction along an airflow that passes between the plurality of heat transfer tubes, as viewed from above, the first header and the second header of each of the first heat exchanger and the second heat exchanger each have straight portions extending along sides of the housing and bent portions located close to corners of the housing that connect the sides of the housing and bent in a horizontal direction, as viewed from above, the first header and the second header also having ends that are provided close to other corners of the housing, the first heat exchanger is provided on a leeward side in the airflow relative to the second heat exchanger, the inlet of the second header of the first heat exchanger is located in a heat-exchange front area that is located on one side of the second header in a direction along a horizontal length, and the outlet of the first header of the first heat exchanger, the inlet of the second header of the second heat exchanger, and the inter-row connecting pipe are located in a heat-exchange end area that is located far from the heat-exchange front area in the direction along the horizontal length and that is located close to another corner of the housing.

2. The heat exchanger of claim 1, further comprising:

a first partition partitioning the first header into right and left spaces;

a second partition partitioning the second header into right and left spaces; and a top-bottom connecting pipe connecting an upstream space in the first header that is partitioned off by the first partition and a downstream space in the second header that is partitioned off by the second partition.

3. The heat exchanger of claim 2, wherein the number of top-bottom connecting pipes in the second heat exchanger is larger than that of top-bottom connecting pipes in the first heat exchanger.

4. The heat exchanger of claim 2, wherein the top-bottom connecting pipe is partially provided along the first header or the second header, and part of the top-bottom connecting pipe that extends vertically is located not to intersect the heat transfer tubes as viewed in a ventilation direction.

5. An air-conditioning apparatus comprising:

a heat exchanger including a first heat exchanger and a second heat exchanger each including a plurality of heat transfer tubes extending in a vertical direction and spaced apart from each other in a horizontal direction, a first header located at lower ends of the plurality of heat transfer tubes, having an outlet for refrigerant, and configured to distribute or combine the refrigerant, and a second header located at upper ends of the plurality of heat transfer tubes, having an inlet for the refrigerant, and configured to distribute or combine the refrigerant;

a flow control valve provided at an upstream pipe located upstream of the inlet of the second header in the first heat exchanger, the flow control valve being configured to adjust a flow rate of the refrigerant that flows into the inlet of the second header in the first heat exchanger;

a branch pipe branching off from the upstream pipe which is located upstream of the flow control valve, and connected with the inlet of the second header in the second heat exchanger; and a controller configured to control the flow control valve in defrosting such that the flow rate of the refrigerant which flows into the inlet of the second header in the first heat exchanger is lower than a flow rate of the refrigerant which flows into the inlet of the second header in the second heat exchanger, wherein in a polygonal housing, the first heat exchanger and the second heat exchanger are arranged in a flow direction along an airflow that passes between the plurality of heat transfer tubes, as viewed from above, the first header and the second header of each of the first heat exchanger and the second heat exchanger each have straight portions extending along sides of the housing and bent portions located close to corners of the housing that connect the sides of the housing and bent in a horizontal direction, as viewed from above, the first header and the second header also having ends that are provided close to other corners of the housing, the first heat exchanger is provided on a leeward side in the airflow relative to the second heat exchanger, the inlet of the second header of the first heat exchanger is located in a heat-exchange front area that is located on one side of the second header in a direction along a horizontal length, and the outlet of the first header of the first heat exchanger and the inlet of the second header of the second heat exchanger are located in a heat-exchange end area that is located far from the heat-exchange front area in the direction along the horizontal length and that is located close to another corner of the housing.

* * * * *